US012203356B2

(12) United States Patent
Zhang et al.

(10) Patent No.: US 12,203,356 B2
(45) Date of Patent: Jan. 21, 2025

(54) TRAJECTORY TRACKING AND OPTIMIZATION FOR DRILLING AUTOMATION

(71) Applicant: Landmark Graphics Corporation, Houston, TX (US)

(72) Inventors: Shang Zhang, Houston, TX (US); Jeremy Codling, Aberdeen (GB); Abhishek Agrawal, Houston, TX (US); Robello Samuel, Houston, TX (US)

(73) Assignee: Landmark Graphics Corporation, Houston, TX (US)

( * ) Notice: Subject to any disclaimer, the term of this patent is extended or adjusted under 35 U.S.C. 154(b) by 114 days.

(21) Appl. No.: 17/895,746

(22) Filed: Aug. 25, 2022

(65) Prior Publication Data

US 2024/0068350 A1 Feb. 29, 2024

(51) Int. Cl.
*E21B 44/00* (2006.01)
*E21B 7/04* (2006.01)

(52) U.S. Cl.
CPC ..... *E21B 44/005* (2013.01); *E21B 7/04* (2013.01); *E21B 2200/22* (2020.05)

(58) Field of Classification Search
CPC . E21B 44/005; E21B 7/04; E21B 7/06; E21B 2200/22
See application file for complete search history.

(56) References Cited

U.S. PATENT DOCUMENTS 7,172,037 B2 2/2007 Dashevskiy et al.
9,598,947 B2 3/2017 Wang et al.
10,801,314 B2 10/2020 Samuel et al.
11,255,180 B2 2/2022 Zhang et al.
2010/0185395 A1 7/2010 Pirovolou et al.
(Continued)

FOREIGN PATENT DOCUMENTS

WO 2021068005 A1 4/2021

OTHER PUBLICATIONS

Liu, et al.; "Wellbore Trajectory Control using Minimum Well Profile Energy Criterion for Drilling Automation"; SPE International; SPE 170861; SPE Annual Technical Conference and Exhibition; Oct. 27-29, 2014, 13 pgs.

*Primary Examiner* — Dany E Akakpo
(74) *Attorney, Agent, or Firm* — Michael Jenney; Parker Justiss, P.C.

(57) ABSTRACT

Processes to receive user input parameters and system input parameters associated with a borehole undergoing active drilling operations to continually update drilling directions with wholistically applied optimizations to bring the actual borehole trajectory closer to the planned borehole trajectory. The processes can project ahead of the drilling assembly to determine the actual trajectory of the borehole and generate corrections to reduce the gap between the actual and planned trajectory paths. Various optimizations can be applied to the corrections to avoid overstressing systems or reducing the borehole productivity. Conflicts between optimizations can be resolved using a weighting or ranking system. More than one set of corrections can be determined and a user or a machine learning system can be used to select the one set of corrections to use as the results to be communicated and applied to the drilling operation plan or a borehole system, such as a geo-steering system.

20 Claims, 7 Drawing Sheets

(56) References Cited

U.S. PATENT DOCUMENTS

| | | | | |
|---|---|---|---|---|
| 2018/0106133 | A1* | 4/2018 | Bolchover | E21B 41/00 |
| 2020/0011167 | A1 | 1/2020 | Zhao et al. | |
| 2020/0149386 | A1 | 5/2020 | Menand | |
| 2022/0049554 | A1* | 2/2022 | Groover | E21B 47/013 |
| 2022/0120176 | A1* | 4/2022 | Gutarov | E21B 47/024 |
| 2022/0259967 | A1 | 8/2022 | Benson et al. | |

* cited by examiner

TRAJECTORY TRACKING AND OPTIMIZATION FOR DRILLING AUTOMATION

TECHNICAL FIELD

This application is directed, in general, to optimizing a drilling plan for drilling through a subterranean formation and, more specifically, to tracking and correcting the drilling plan.

BACKGROUND

In developing a borehole, such as for hydrocarbon production, scientific purposes, or other purposes, it can be important to know the relative trajectory of a drilled borehole, and the projected borehole path for the next drilling stage. The projected borehole path can be influenced by the subterranean formation, such as knowing where the stratigraphic layers are, where reservoirs are, and knowing the type or characteristics of the rock making up the subterranean formation. The drilling tools used can influence the path as well, such as the type of drill bit and drill assembly, the flexibility of the drill pipe, and other factors. Being able to track these influencing factors, their risk and impact on drilling operations, and then correcting and optimizing the drilling plan would be beneficial.

SUMMARY

In one aspect, a method is disclosed. In one embodiment, the method includes (1) receiving user input parameters associated with a drilling operation of a borehole, (2) receiving system input parameters, wherein the system input parameters include sensor parameters, where a drilling assembly is at a downhole end of the borehole, the sensor parameters are used to extrapolate an actual borehole trajectory, and the system input parameters are received in real-time or near real-time, (3) determining corrections to the actual borehole trajectory, wherein the corrections describe drilling parameter changes to align the actual borehole trajectory with a planned borehole trajectory, (4) optimizing the corrections to generate revised corrections, wherein one or more optimizations are selected to be applied to the corrections, and each optimization of the one or more optimizations utilizes a respective optimization range parameter, and (5) determining one or more results utilizing the revised corrections, the user input parameters, or the system input parameters, wherein the results specify a change to a drilling operation plan or directions for the drilling assembly.

In a second aspect, a system is disclosed. In one embodiment, the system includes (1) a data transceiver, capable of receiving user input parameters and system input parameters for a borehole, wherein the system input parameters include sensor parameters from a drilling system, surface equipment, or subterranean formation parameters near the drilling system, and (2) a drilling optimizer processor, capable of communicating with the data transceiver, generating one or more corrections utilizing the user input parameters and the system input parameters, revising the one or more corrections utilizing one or more optimizations to generate revised corrections, and determining one or more results using the revised corrections.

In a third aspect, a computer program product having a series of operating instructions stored on a non-transitory computer-readable medium that directs a data processing apparatus when executed thereby to perform operations to determine one or more results is disclosed. In one embodiment, the operations include (1) receiving user input parameters associated with a drilling operation of a borehole, (2) receiving system input parameters, wherein the system input parameters include sensor parameters, where a drilling assembly is at a downhole end of the borehole, the sensor parameters are used to extrapolate an actual borehole trajectory, and the system input parameters are received in real-time or near real-time, (3) determining corrections to the actual borehole trajectory, wherein the corrections describe drilling parameter changes to align the actual borehole trajectory with a planned borehole trajectory, (4) optimizing the corrections to generate revised corrections, wherein one or more optimizations are selected to be applied to the corrections, and each optimization of the one or more optimizations utilizes a respective optimization range parameter, and (5) determining one or more results utilizing the revised corrections, the user input parameters, or the system input parameters, wherein the results specify a change to a drilling operation plan or directions for the drilling assembly.

BRIEF DESCRIPTION

Reference is now made to the following descriptions taken in conjunction with the accompanying drawings, in which.

DETAILED DESCRIPTION

Figure 1:
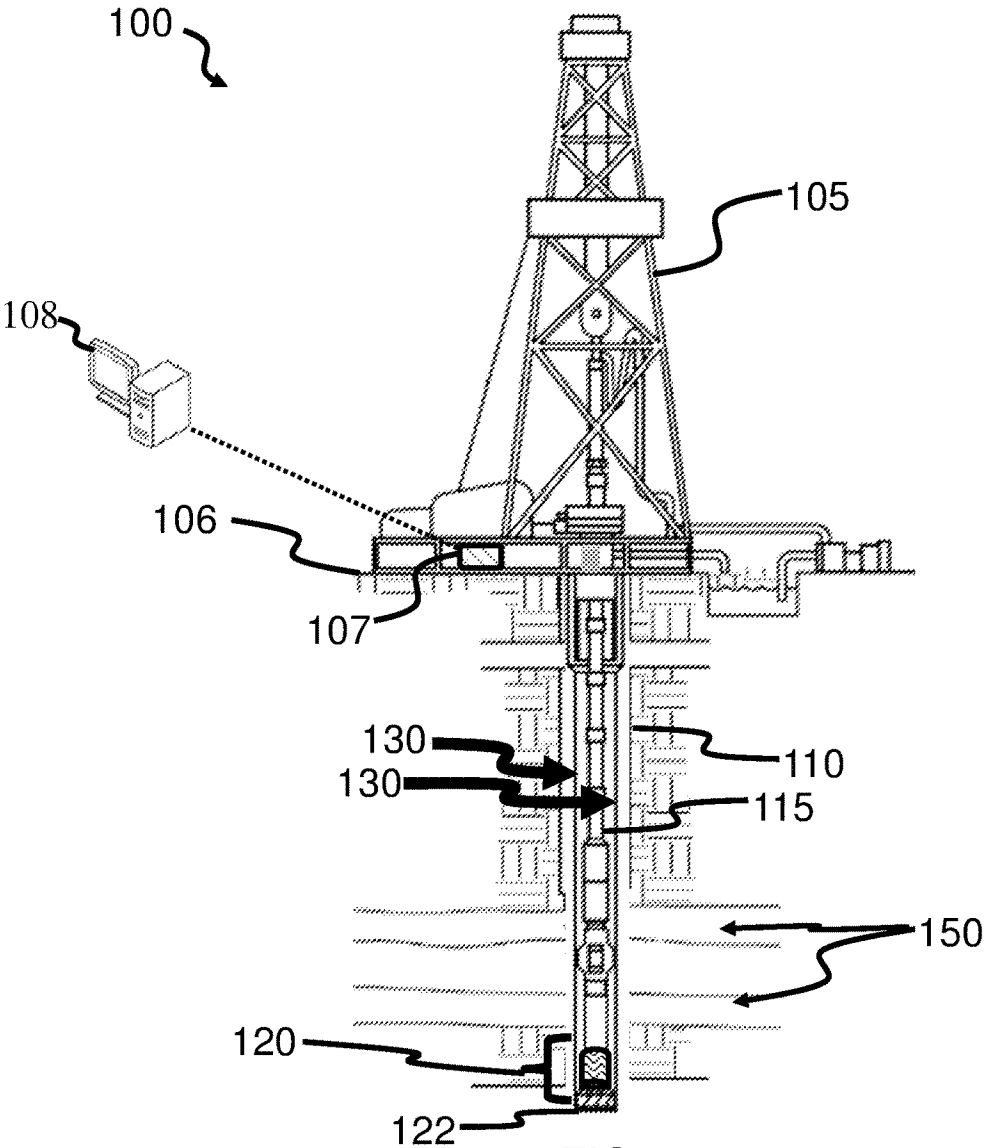
FIG. 1 is an illustration of a diagram of an example drilling system.

In borehole development, users, such as well operators or engineers, can use geo-steering techniques to maintain borehole development, e.g., drilling operations, along an intended path and direction. Knowing the position, and to project and direct, the future path of the borehole relative to nearby subterranean formations, proximate boreholes, and objects can be beneficial to ensure borehole distancing, separation, or borehole interception at the desired location, for example, maximizing the potential production from a subterranean formation reservoir. The borehole development can be for various uses, for example, hydrocarbon production, geothermal uses, scientific uses, mining uses, and other uses of boreholes.

The industry has been working toward improving drilling efficiencies, offset-well learning, and automated detection and interpretation of drilling events and dysfunctions. Challenges have arisen from the work to develop these drilling efficiencies. Some of the challenges are that during drilling, the borehole can deviate from the original drilling operation plan. When a borehole deviates from the plan, there might be a potential borehole collision hazard. Therefore, the trajectory of the borehole path should be closely monitored and periodically corrected to avoid incidents, and to hit the planned target in the drilling operation plan.

As the industry shifts to drilling automation, less manual control can be involved during drilling operations. Automated systems would need to understand the various scenarios and risks, to balance recommendations and directions for the drilling operation plan, so that decisions can be made by the implemented systems. Current drilling trajectory control systems can be subjective, non-time sensitive, and not optimized. Current solutions in the industry are focused on data visualization and not engineering calculations. Latency in the receiving downhole data can lead to the data representing what happened 10 to 50 feet behind the current position of the drilling assembly, which makes the process more difficult to bring the drilling assembly back to the targeted planned trajectory. This disclosure combines geometric, mechanical, drill-ability, hydraulic, productivity, artificial intelligence (AI), and machine learning (ML).

This disclosure presents processes to provide an drilling trajectory optimizer that can generate one or more results, including recommendations, adjustments, and directions to direct drilling operations and future drilling stages (e.g., drilling parameter changes). The results can be used to maintain or improve operations within a safe operating zone or a target operating zone using the current drilling parameters and borehole trajectory information. In some aspects, the processes can be performed in real-time or near real-time, as well at periodic time or drilling distance intervals. Real-time and near real-time is intended to accommodate the time taken for data to be communicated uphole and downhole as well as the time for processing the results using the received data. For example, instructions can be sent downhole, then collected data can be communicated uphole, results processed, and then directions can be communicated downhole, such as to a geo-steering system or bottom hole assembly (BHA).

In some aspects, the results can include solutions to provide trajectory monitoring, tracking, correction, and optimization. In some aspects the results can provide or communicate feedback, notifications, or alarms, such as if the processes detect a safety concern or a factor that would negatively impact the operations, such as detecting a water-hydrocarbon boundary. In some aspects, the processes provide input into the drilling automation system to improve the optimized drilling strategy and can periodically optimize its output, and in some aspects, the optimized output can be output in real-time or near real-time. In some aspects, the processes can be implemented using a microservice, a standalone device, or a software application running on a computing system, such as a well site controller, a downhole computing system, or other computing systems. In some aspects, a machine learning system can be implemented, such as to process time-series analysis algorithms to account for noise and spikes in collected data to avoid the results from overreacting to measurement errors.

In some aspects, once the deviation from the planned trajectory is detected, the processes can recalculate the drilling trajectory and provide suitable drilling parameters and directions to bring the actual borehole path back to the planned trajectory. This trajectory correction can be done manually by drilling engineers or automatically done by the drilling automation systems, such as directions to a geo-steering system.

In more detail, the disclosed processes can utilize real-time, near real-time, or periodic (time intervals, e.g., time interval parameter or drilling distance intervals, e.g., distance interval parameter) implementations during drilling operations. For example, the process can be performed after a time period, such as a time interval parameter, after a drilling distance has been covered, such as a distance interval parameter, or the process can be performed as continuously as possible given the constraints of communicating data between systems, such as uphole and downhole communication latency.

Data collected downhole by downhole sensors or from surface sensors can be communicated to a drilling optimizer. The collected data can be communicated to the drilling optimizer in real-time, near real-time, or at periodic intervals (collectively, a time interval). The drilling optimizer can be a system downhole, such as part of a BHA or a geo-steering system, a system at the surface, such as a well site controller, server, mobile device, or other computing system, or a system distant from the borehole, such as a cloud environment, edge computing system, data center, or other distance computing system. Utilizing one or more selected trajectory survey calculation algorithms and anti-collision error models, the borehole trajectory can be constructed and updated as more recent data is communicated to the system.

At each time interval, the received data for the current time interval can be used to calculate recommendations or corrections to the drilling trajectory. At a subsequent time interval, the received data for that subsequent time interval can be used as feedback on the previous iteration of the process thereby improving the recommendations or corrections generated by the process for the subsequent time interval, e.g., optimizing the corrections. The iterations will continue at each subsequent time interval until the operations for the drilling stage have completed or another end or stop point is reached. The time interval for real-time or near real-time is approximately the time it takes for new received data to be received at the processor, where an iteration is not needed if the received data has not yet been updated.

For an example of the time interval iterative process, at a time interval 0, a deviation between the planned borehole trajectory and the actual borehole trajectory is detected, such as a threshold of the planned borehole trajectory is exceeded. The threshold can be a user defined distance value or a default value. In this example, the actual borehole trajectory can be x feet away in a specific direction, such as 100 feet to the South and 80 feet to the East. The process can generate a correction, such as to set the drill bit a 10 degree inclination and adjust the azimuth 15 degrees West. The process can indicate an estimate of the actual borehole trajectory at the subsequent time interval, such as the actual borehole trajectory will be 80 feet away to the South and 50 feet away to the East.

Received system input parameters (received data) for the subsequent time interval, time interval 1, can indicate the then actual borehole trajectory, such as being 90 feet away to the South and 10 feet away to the West. The predicted location may or may not be represented. The time interval 1 system input parameters can be used to improve the optimization portion of the processing (by corresponding to the time interval 0 corrections) to improve the corrections generated for time interval 1. A new set of corrections can be generated, updating the drilling directions and instructions. The process can be repeated at time interval 2 and subsequent time intervals until the processes is stopped or ended.

The process can utilize the planned borehole trajectory, as communicated from a drilling operation plan, and compare the planned borehole trajectory to the measured borehole path as represented by the collected data. In some aspects, machine learning can be utilized to implement time-series analysis algorithms which can reduce the impact of noise (such as drilling system vibrations) or data spikes from downhole data to reduce overreacting to the measurement errors of the collected data.

In an aspect where a deviation from the planned trajectory is detected. The processes can recalculate the borehole trajectory and generate results, such as drilling parameters and directions, to bring the borehole path back to the planned trajectory. The updates to the drilling operations can be implemented by a user or automatically by the drilling automation systems, such as a geo-steering system or a well site controller.

The back-to-plan borehole trajectory corrections can be optimized by a series of drilling system optimizations. One or more optimizations can be utilized (e.g., selected), from one or more categories. The selection can be by default, by region or subterranean formation characteristics, or specified by a user. The selection of optimizations can be modified for a subsequent execution of the processes, for example, as soon as the collected data indicates that a water-hydrocarbon boundary is being approached, the selected optimizations can be changed.

For example, for geometric optimizations, the optimizations can include, a minimum drill path parameter, a trajectory torsion parameter, a trajectory curvature parameter, a minimum borehole-profile energy, or other geometric parameters. For mechanical optimizations, the optimizations can include a drill pipe bending parameter, a drill pipe torsion parameter, a BHA analysis parameter, a minimum borehole-profile energy parameter, or other mechanical parameters. For drill-ability optimizations, the optimizations can include a dog-leg severity parameter, a maximum build rate parameter, a maximum turn rate parameter, a minimum borehole-profile energy parameter, a drilling speed parameter, a drill bit rotations parameter, a drill bit wear parameter, or other drill-ability parameters. For hydraulic optimizations, the optimizations can include friction parameters, a drill mud equivalent circulating density parameter, a cutting removal parameter, or other hydraulic optimizations. For productivity optimizations, the optimizations can include a maximum well productivity parameter, or other productivity optimizations. Other optimizations can be included, such as stratigraphic layer optimizations, AI optimizations, ML optimizations, risk parameters, safety parameters, or other optimizations now know or later developed.

In some aspects, the optimizations selected for use can utilize an optimization weighting parameter, where the optimization weighting parameter can be a user input. For example, a user can specify that time savings is weighted higher than drill bit wear. In some aspects, the results can provide a priority order of the drilling directions in scenarios where more than one drilling direction is determined. In some aspects, the results can provide a confidence level for the drilling directions. In aspects where a priority or confidence level is provided, a user can utilize this information to determine the drilling directions for the drilling system.

Turning now to the figures, FIG. 1 is an illustration of a diagram of an example drilling system 100, for example, a logging while drilling (LWD) system, a measuring while drilling (MWD) system, a seismic while drilling (SWD) system, a telemetry while drilling (TWD) system, injection well system, extraction well system, and other borehole systems. Drilling system 100 includes a derrick 105, a well site controller 107, and a computing system 108 (collectively, surface equipment). Well site controller 107 includes a processor and a memory and is configured to direct operation of drilling system 100. Derrick 105 is located at a surface 106.

Extending below derrick 105 is a borehole 110 with downhole tools 120 at the downhole end of a drill string 115. Downhole tools 120 can include various downhole tools, such as a formation tester or a BHA. Downhole tools 120 can include a resistivity tool or an ultra-deep resistivity tool. At the bottom of downhole tools 120 is a drilling bit 122. Other components of downhole tools 120 can be present, such as a local power supply (e.g., generators, batteries, or capacitors), telemetry systems, sensors, transceivers, and control systems. Borehole 110 is surrounded by subterranean formation 150.

Well site controller 107 or computing system 108 which can be communicatively coupled to well site controller 107, can be utilized to communicate with downhole tools 120, such as sending and receiving acoustic data, telemetry, data, instructions, subterranean formation measurements, and other information. Computing system 108 can be proximate well site controller 107 or be a distance away, such as in a cloud environment, a data center, a lab, or a corporate office. Computing system 108 can be a laptop, smartphone, PDA, server, desktop computer, cloud computing system, other computing systems, or a combination thereof, that are operable to perform the processes described herein. Well site operators, engineers, and other personnel can send and receive data, instructions, measurements, and other information by various conventional means, now known or later developed, with computing system 108 or well site controller 107. Well site controller 107 or computing system 108 can communicate with downhole tools 120 using conventional means, now known or later developed, to direct operations of downhole tools 120.

Casing 130 can act as barrier between subterranean formation 150 and the fluids and material internal to borehole 110, as well as drill string 115. A drilling trajectory optimizer can be present, such as a drilling optimizer processor or an drilling optimizer controller (e.g., an drilling optimizer controller). The drilling trajectory optimizer can receive system input parameters from sensors located downhole, such as part of the downhole tools 120 or part of the bottom hole assembly (BHA). In some aspects, the drilling trajectory optimizer can generate analysis of the various sensor inputs and determine recommendations for directing the drilling operations. In some aspects, the drilling trajectory optimizer can produce visual graphs enabling a user to see the approximate subterranean formation features and the projected borehole path. In some aspects, the drilling trajectory optimizer can combine other data measurements, such as from another location within the borehole, proximate boreholes, a surface location, models, survey data, geological data, such as from a data center, database, or cloud environment.

In some aspects, the drilling trajectory optimizer can communicate the results (e.g., recommendations, optimized drilling plan, or updated drilling parameters to maintain a targeted drilling trajectory) to another system, such as computing system 108 or well site controller 107 where the results can be combined with other analysis or used for decision making processes. In some aspects, computing system 108 can be the drilling trajectory optimizer and can receive some of the system input parameters from one or more of the sensors in downhole tools 120. In some aspects, well site controller 107 can be the drilling trajectory optimizer and can receive some of the system input parameters from one or more of the sensors part of downhole tools 120.

In some aspects, the drilling trajectory optimizer can be partially included with well site controller 107 and partially located with computing system 108.

Figure 2:
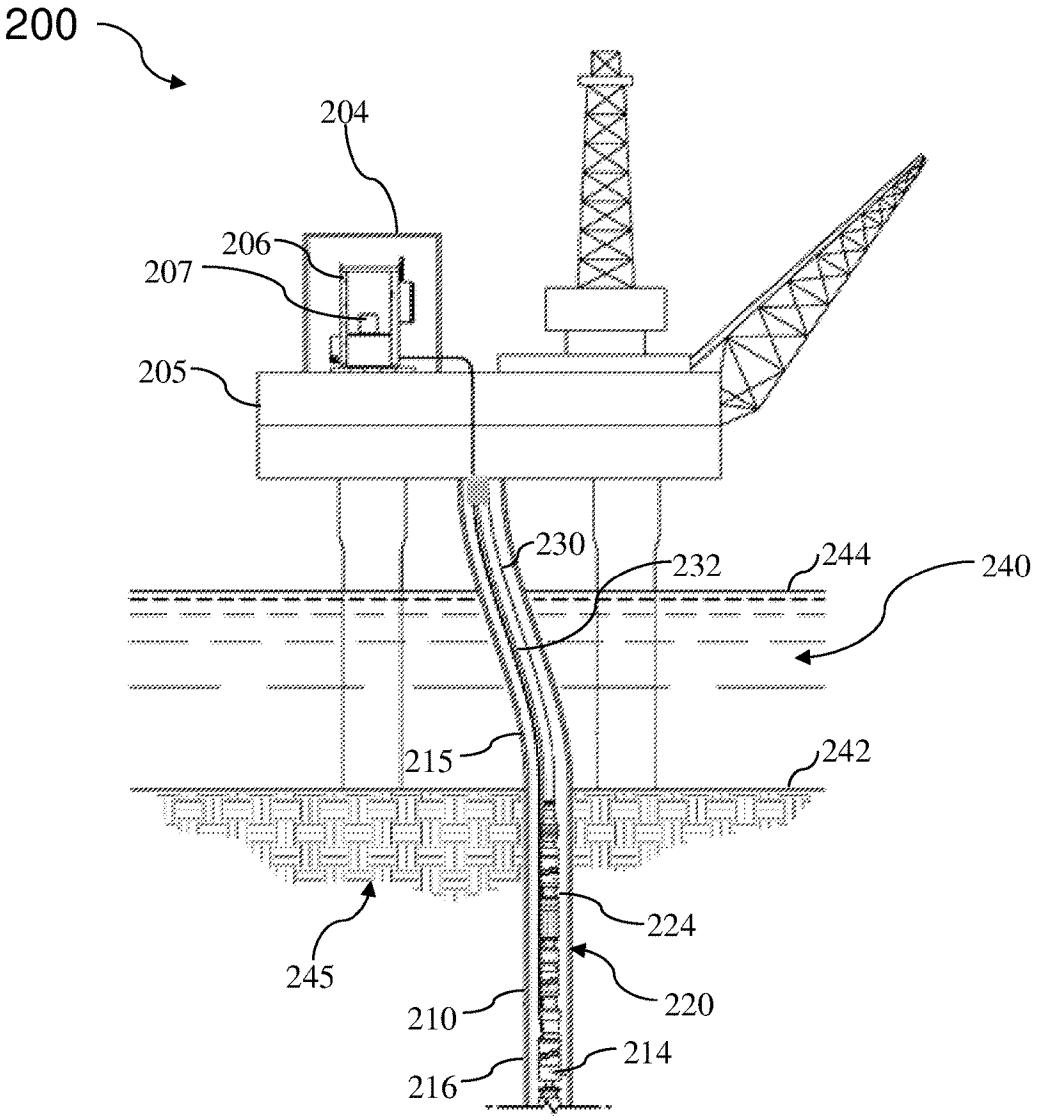
FIG. 2 is an illustration of a diagram of an example offshore drilling system.

FIG. 2 is an illustration of a diagram of an example offshore system 200 with an electric submersible pump (ESP) assembly 220. ESP assembly 220 is placed downhole in a borehole 210 below a body of water 240, such as an ocean or sea. Borehole 210, protected by casing, screens, or other structures, is surrounded by subterranean formation 245. ESP assembly 220 can be used for onshore operations. ESP assembly 220 includes a well controller 207 (for example, to act as a speed and communications controller of ESP assembly 220), an ESP motor 214, and an ESP pump 224.

Well controller 207 is placed in a cabinet 206 inside a control room 204 on an offshore platform 205 (e.g., surface equipment), such as an oil rig, above water surface 244. Well controller 207 is configured to adjust the operations of ESP motor 214 to improve well productivity. In the illustrated aspect, ESP motor 214 is a two-pole, three-phase squirrel cage induction motor that operates to turn ESP pump 224. ESP motor 214 is located near the bottom of ESP assembly 220, just above downhole sensors within borehole 210. A power/communication cable 230 extends from well controller 207 to ESP motor 214. A fluid pipe 232 fluidly couples equipment located on offshore platform 205 and ESP pump 224.

In some aspects, ESP pump 224 can be a horizontal surface pump, a progressive cavity pump, a subsurface compressor system, or an electric submersible progressive cavity pump. A motor seal section and intake section may extend between ESP motor 214 and ESP pump 224. A riser 215 separates ESP assembly 220 from water 240 until sub-surface 242 is encountered, and a casing 216 can separate borehole 210 from subterranean formation 245 at and below sub-surface 242. Perforations in casing 216 can allow the fluid of interest from subterranean formation 245 to enter borehole 210.

Figure 5:
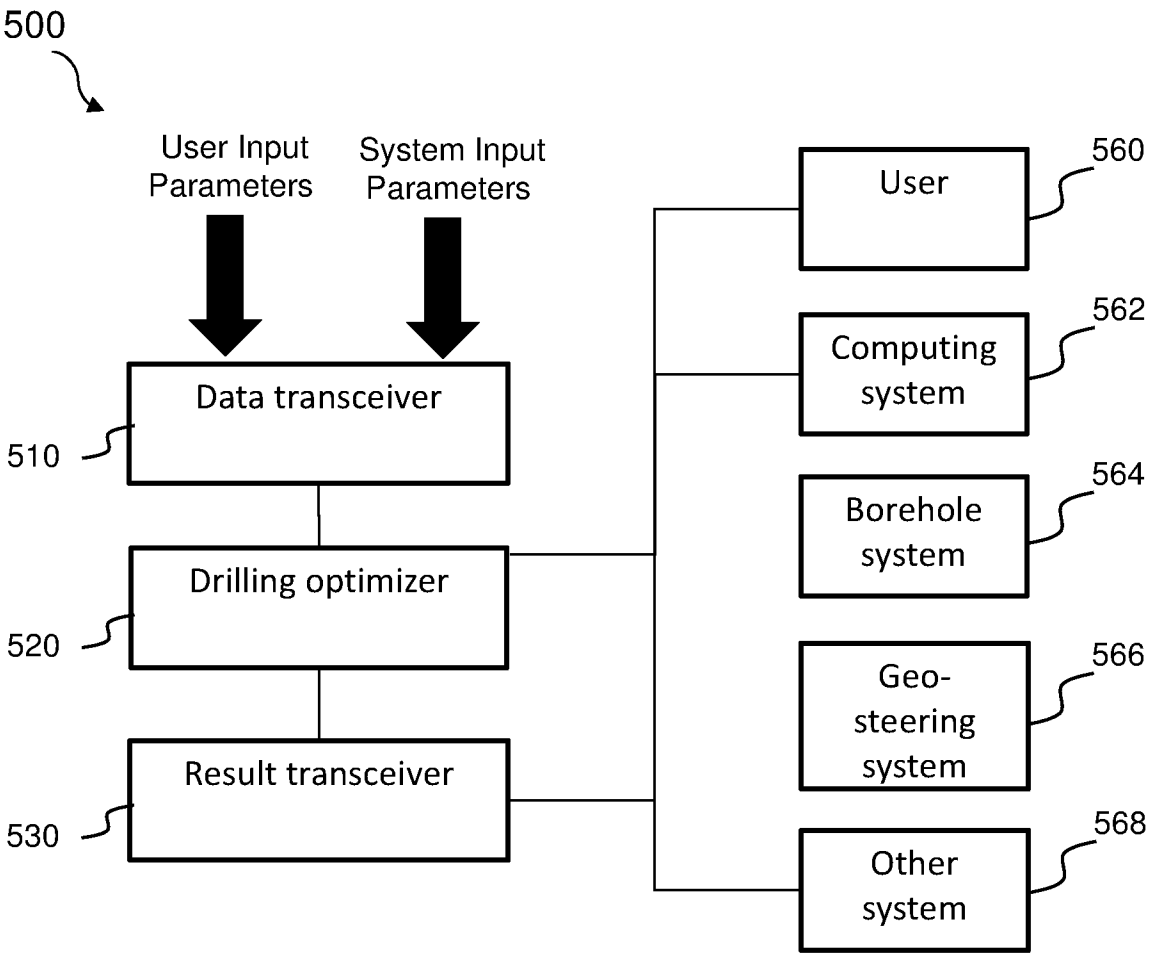
FIG. 5 is an illustration of a block diagram of an example drilling optimizer.
Figure 6:
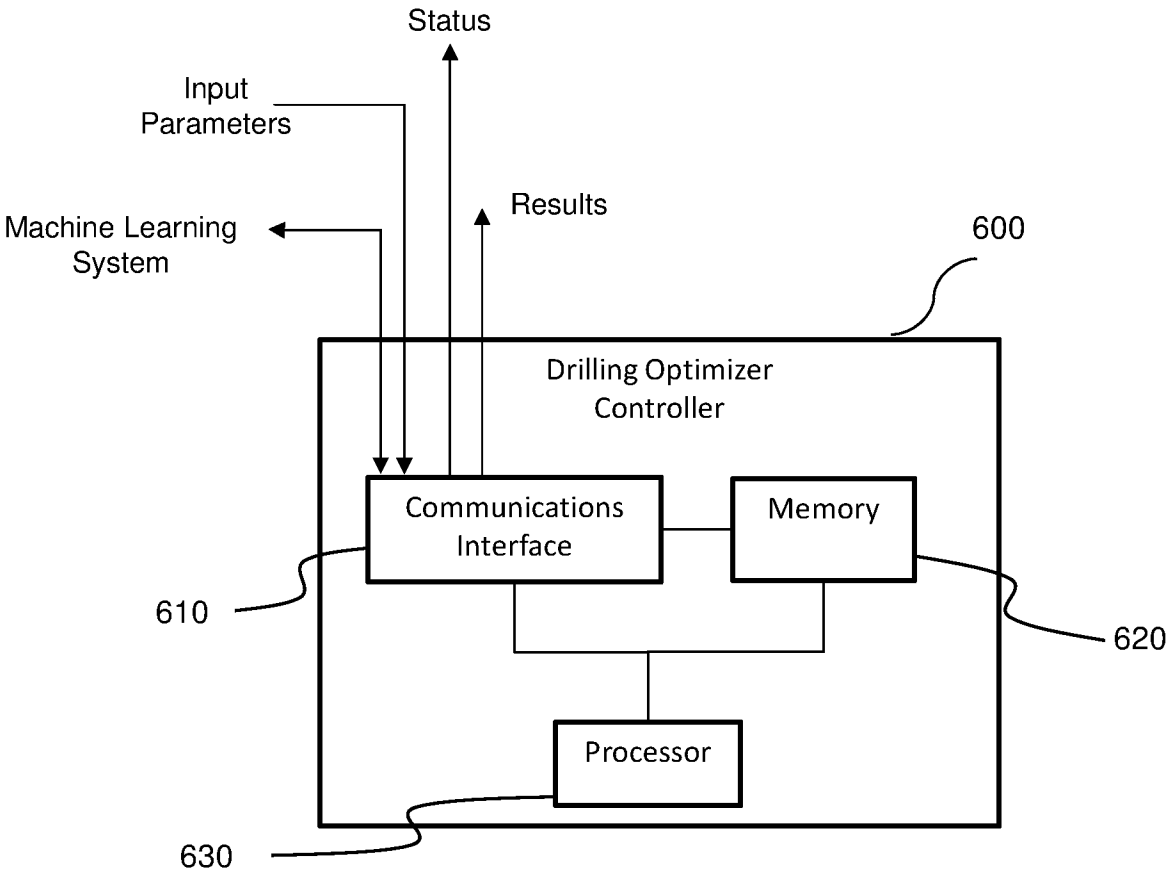
FIG. 6 is an illustration of a block diagram of an example of drilling optimizer controller according to the principles of the disclosure.

ESP assembly 220 can include a drilling trajectory optimization system, such as a drilling optimizer 500 of FIG. 5 or drilling optimizer controller 600 of FIG. 6. The results of the drilling trajectory system can be communicated to one or more other systems, such as well controller 207. Well controller 207 can be the drilling optimizer or the drilling optimizer controller. In some aspects, the drilling optimizer or the drilling optimizer controller can be partially in well controller 207, partially in another computing system, or various combinations thereof. The results of the drilling optimizer or the drilling optimizer controller can be used to generate one or more drilling parameters, recommendations, or updates to the drilling operation plan.

FIG. 1 depicts onshore operations. Those skilled in the art will understand that the disclosure is equally well suited for use in offshore operations, such as shown in FIG. 2. FIGS. 1-2 depict specific borehole configurations, those skilled in the art will understand that the disclosure is equally well suited for use in boreholes having other orientations including vertical boreholes, horizontal boreholes, slanted boreholes, multilateral boreholes, and other borehole types.

Figure 3A:
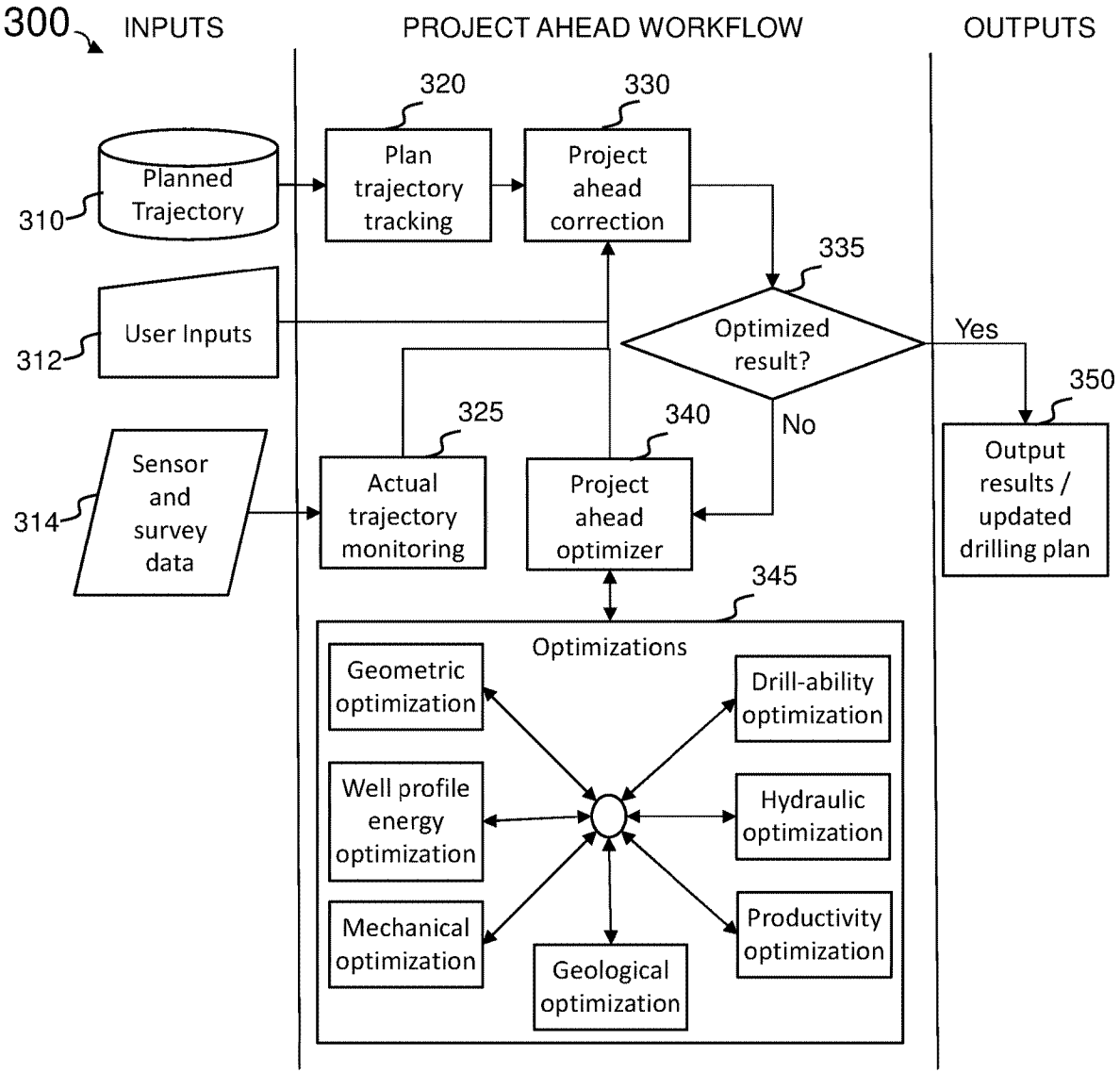
FIG. 3A is an illustration of a flow diagram of an example drilling trajectory optimization process.

FIG. 3A is an illustration of a flow diagram of an example drilling trajectory optimization process 300. Drilling trajectory optimization process 300 can be implemented, for example, by drilling optimizer 500 of FIG. 5 or drilling optimizer controller 600 of FIG. 6. Drilling trajectory optimization process 300 demonstrates one implementation of the disclosed processes using a functional view. Drilling trajectory optimization process 300 can be implemented in three portions, an Input portion, a Project Ahead Workflow portion, and an Output portion.

The Input portion shows some of the various inputs that can be received. Datastore 310 shows the planned trajectory from the drilling operation plan. Datastore 310 can be a database, a file, a memory, or other types of data storage systems.

User inputs 312 can be the user input parameters supplied by users, for example, a time interval for a periodic execution of the processes, a selection of optimizations (such as if a subset of optimizations are to be used), a weighting of the selected optimizations, one or more trigger, alarm, or notification thresholds (such as being within x distance of a water-hydrocarbon boundary), respective optimization range parameters, or other types of user input. Some optimizations may not be applicable, such as optimizations designed for one type of geological formations, while the borehole being analyzed has a different type of geological formation.

Sensors 314 can communicate system parameters regarding the active drilling operation, such as parameters on the drilling assembly (drill bit wear, rotations per minute, distance covered per minute, or other drilling assembly parameters), parameters on the subterranean formation (geological characteristics, stratigraphic layers, boundaries between fluid types, or other subterranean formation parameters), or other parameters used within the processes. Sensors 314 can be various combinations of surface sensors, downhole sensors, and other sensors and data sources, such as sensors from proximate boreholes. Sensors 314 can be various combinations of types of sensors, for example, nuclear magnetic resonance, seismic, fluid detection, acoustic, and other sensor types.

The Project Ahead Workflow portion can receive the various user input parameters and system input parameters, and process the optimizations. Plan trajectory tracking 320 can receive the planned trajectory parameters. Actual trajectory monitoring 325 can receive the various sensor parameters indicating the current position and trajectory of the drilling assembly, as well as updated subterranean formation characteristics. Project ahead correction 330 can receive the planned trajectory parameters and the actual parameters and perform an analysis to determine a first pass at determining the results, e.g., corrections, to the drilling plan.

In a decision flow 335, the corrections can be checked if they are optimized. If the resultant is "Yes", then the flow can continue to an output 350. If the resultant is "No", then project ahead optimizer 340 can apply one or more optimizations to the results to generate revised results which can then be communicated back to project ahead correction 330. Project ahead optimizer 340 can utilize the selected set of optimizations, whether selected by default or by user input. The set of optimizations can be determined and applied using optimizations 345.

Optimizations 345 show for demonstration, geometric optimizations, well profile energy optimizations, mechanical optimizations, drill-ability optimizations, hydraulic optimizations, productivity optimizations, and geological optimizations. In some aspects, the optimizations can include additional or fewer optimizations. In some aspects, some of the optimizations can be replaced by other optimization types. The optimizations can conflict with one another, such as penetration rate versus bit wear. Conflicts can be resolved in some aspects using a weighted optimization scheme, where one type of optimization is ranked lower than another and so the higher weighted optimization will control the determined result. In other aspects, conflicts can be resolved by presenting more than one recommendation, such as a ranked list of results from which a user or system would need to select a result to be utilized further.

In the Output portion, output 350 can receive the results and add additional corrections to make the results actionable by the drilling system, and then communicate the revised results to the drilling system, such as a drilling operation planning system or a geo-steering system. In some aspects, output 350 can present options, for example, a ranked list of optional recommendations, to a user or a system for evaluation. One of the options can be selected and then communicated to the drilling system. In some aspects, a machine learning system can be used to evaluate the options and perform the selection process.

Figure 3B:
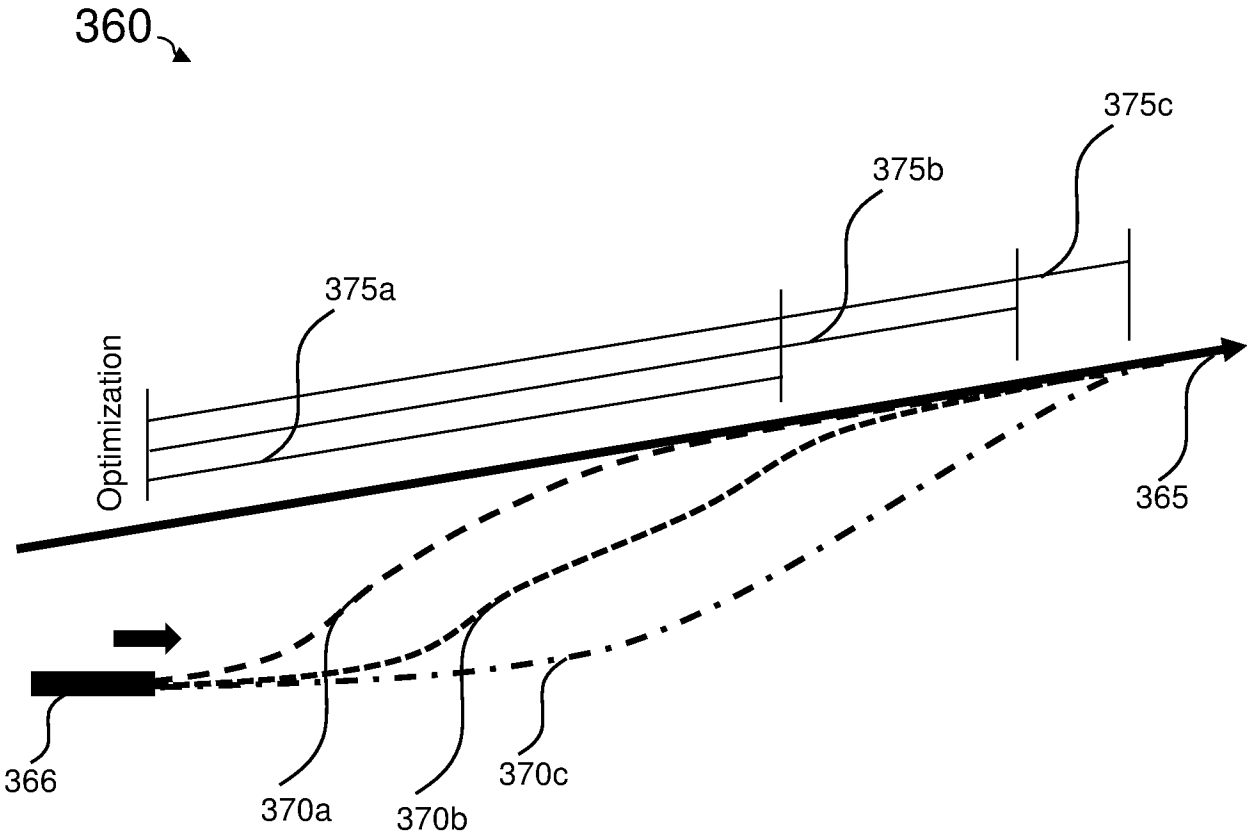
FIG. 3B is an illustration of a diagram of an example trajectory path recommendation building on FIG. 3A.

FIG. 3B is an illustration of a diagram of an example trajectory path recommendation 360 building on FIG. 3A. Trajectory path recommendation 360 visually demonstrates three trajectory recommendations that are generated and shows a difference in how quickly each recommendation approaches the planned borehole path. Trajectory path recommendation 360 has a planned borehole path 365 (the planned borehole trajectory), where the arrow head indicates the direction of drilling operations. A drilling assembly 366 indicates the actual position of the drilling assembly relative to planned borehole path 365, where the proximate arrow indicates the direction of drilling.

The disclosed processes have generated three recommendations in this example. A recommendation 1 370*a*, a recommendation 2 370*b*, and a recommendation 3 370*c* (collectively, recommendations 370) are shown with varying corrections being made to bring the actual drilling path back to planned borehole path 365. Recommendations 370 can be weighted, be ranked, or otherwise be ordered to allow a decision to made to select one of the recommendations to implement as updated instructions, i.e., directions, to drilling assembly 366.

Optimization indicators are shown to demonstrate the distance required to bring the actual borehole trajectory to within the threshold of the planned borehole trajectory. Recommendation 1 370*a* corresponds to an optimization bar 375*a*, recommendation 2 370*b* corresponds to an optimization bar 375*b*, and recommendation 3 370*c* corresponds to an optimization bar 375*c* (collectively, optimization bars 370).

Figure 4:
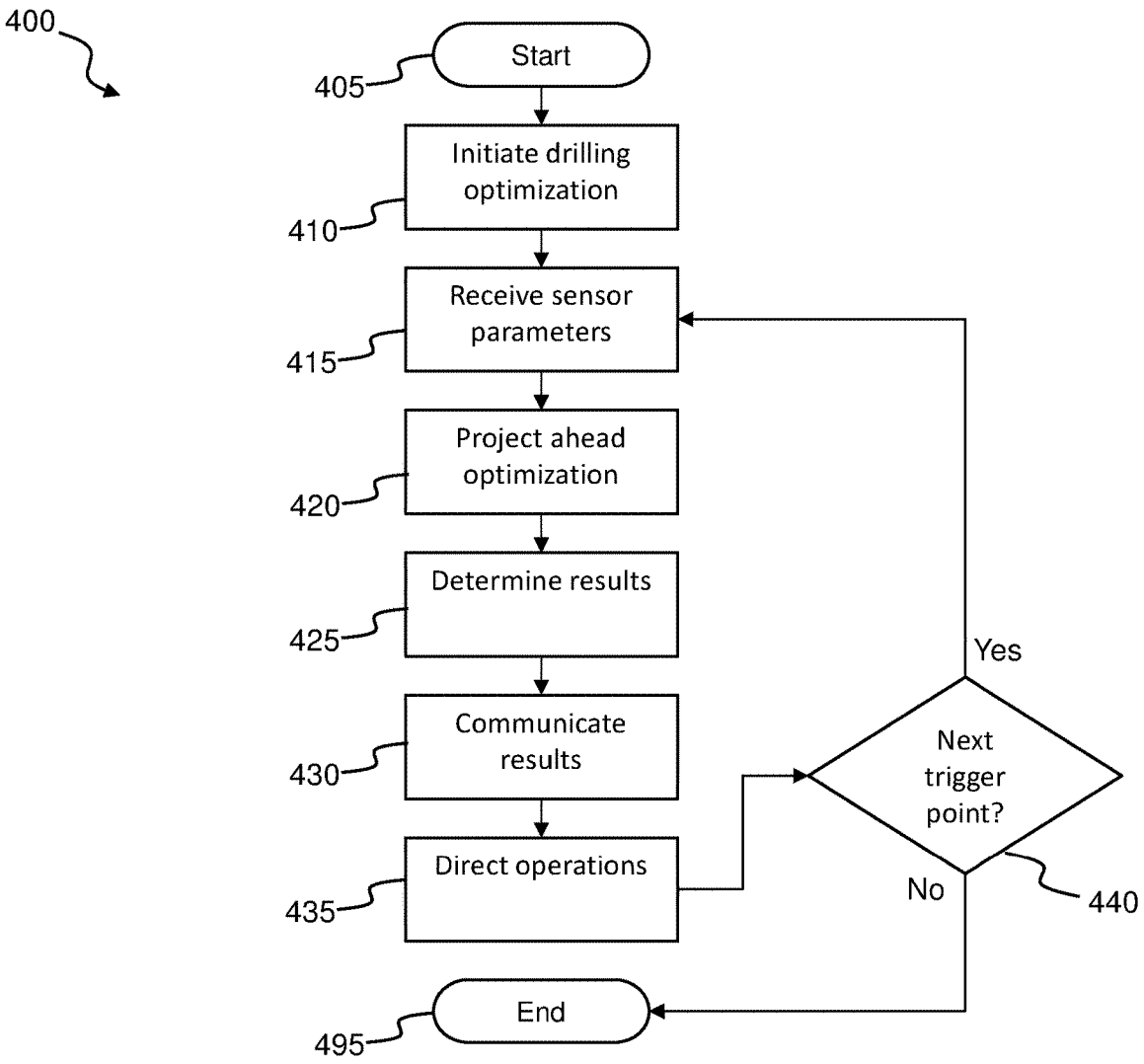
FIG. 4 is an illustration of a flow diagram of an example method for optimizing a drilling trajectory.

FIG. 4 is an illustration of a flow diagram of an example method 400 for optimizing a drilling trajectory. Method 400 demonstrates the process and functional steps of drilling trajectory optimization process 300 using method steps. Method 400 can be performed on a computing system, for example, drilling optimizer 500 of FIG. 5 or drilling optimizer controller 600 of FIG. 6. The computing system can be a reservoir controller, a well site controller, a geo-steering system, a data center, a cloud environment, a server, a laptop, a mobile device, smartphone, PDA, or other computing system capable of receiving the input parameters, and capable of communicating with other computing systems. Method 400 represents an algorithm that can be encapsulated in software code or in hardware, for example, an application, code library, dynamic link library, module, function, RAM, ROM, and other software and hardware implementations. The software can be stored in a file, database, or other computing system storage mechanism, such as an edge computing system. Method 400 can be partially implemented in software and partially in hardware. For example, at least of portion of the steps of method 400 can correspond to an algorithm represented by a series of operating instructions stored on a non-transitory computer readable medium.

Method 400 can perform the steps for the described processes, for example, collecting system input parameters from sensors located downhole, surface sensors, data stores, and other computing systems where data can be retrieved and analyzing the data to compute one or more result recommendations. For example, system input parameters can be received from downhole sensors, such as rotations per minute (RPM), drill bit wear, subterranean formation characteristics, borehole geometric properties, and other drilling parameters. System input parameters can be received from drilling rig sensors, such as weight on bit (WOB) or rig limits. System input parameters can be received from other sources, such as engineering models, surveys, geological data, generally available stratigraphic data, and other data sources. Method 400 is a demonstration of some of the differing systems that can provide system input parameters and a demonstration of some of the drilling parameters and impact parameters that are analyzed. In practice, the implementation can extend to various systems providing system input parameters and to various drilling parameters now known or identified in the future, and various impact parameters.

Method 400 starts at a step 405 and proceeds to a step 410. In step 410, the processes can begin to be performed. This can be at a periodic time interval, periodic borehole drilling distance, or in real-time or near real-time accounting for the time to communicate parameters and instructions up and down hole. User input parameters can be received, such as a selection of optimizations to apply, the periodic interval to utilize (such as a periodic drilling distance interval parameter or a periodic time interval parameter), the thresholds to use for alarms, alerts, or notifications (such as being within a distance to a water-hydrocarbon boundary), optimization range parameters, and other user input parameters. The planned trajectory parameters as well as other drilling plan parameters can be received. The user input parameters and other parameters received can be for a drilling stage, a portion of a drilling stage, or apply across more than one drilling stage.

In a step 415, sensor parameters can be received, e.g., system input parameters. Sensor parameters can be received from downhole sensors, uphole sensors, surface sensors, equipment sensors, or sensors associated with proximate boreholes. The type of sensors can be various types of sensors employed in drilling operations.

In a step 420, optimizations can be applied projecting the borehole trajectory ahead of the current position of the drilling assembly. A delta or correction can be determined between the actual borehole trajectory and the planned borehole trajectory. The correction can include parameters to bring the actual trajectory back to or closer to the planned trajectory. The corrections can then be processed through an optimization process that looks wholistically at the selected optimizations.

The optimization process can revise or adjust the corrections to maintain a safe and productive borehole drilling operation. For example, a steep angle may bring the actual trajectory closer to the planned trajectory at a faster rate than a smaller deviation angle, with a cost of exceeding a bending angle of the drill pipe. Therefore, a smaller angle of deviation would be desirable.

There can be interactions between various optimizations and categories of optimizations, so more than one pass through the optimizations can be done until the optimizations are satisfied. A user input parameter can be used to specify a range within which an optimization is satisfied, such as using an optimization range parameter. For example, an optimization for bit wear can specify a bit wear reduction of 5% per interval, while a bit wear of 10% per interval is the maximum acceptable wear for the drilling operations. An optimization range parameter can specify a range of 0-5%, 0-10%, or other ranges as appropriate. Weighting and ranking of the optimizations can be utilized to assist in resolving conflicts among the optimizations.

In a step 425, the results can be determined from the revised corrections. The results can include the changes to the drilling plan to bring the actual borehole trajectory closer to the planned borehole trajectory, as well as directions that can be communicated to a user, a borehole system, or geo-steering system. In some aspects, more than one result can be communicated, such as if two results have the same weighting factors. In this aspect, a user or a machine learning system can evaluate the results and select the one that best fits the goals and risks associated with the current borehole operations. For example, increasing the rate of penetration may be more valuable than avoiding breaking drill pipe segments. In some aspects, a confidence level can be associated with a result. The confidence level can be used by the user, machine learning system, or other borehole system to evaluate the various results communicated by the disclosed processes. The confidence level can be any range of values, for example, 1 to 5, 1 to 10, A to E, or other ranges.

In a step 430, the results can be communicated to a user, a machine learning system, a well site controller, a geo-steering system, a BHA, a drilling assembly, or other borehole system.

In a step 435, the results can be utilized to update the drilling operation plan and direct future operations of the drilling assembly. The drilling assembly can be provided updated directions as quickly as the results can be communicated to the drilling assembly. For example, when the optimization process is occurring at a surface computing system, the results can be communicated downhole and the drilling assembly can react as soon as the results are received and processed.

In a decision step 440, the process can evaluate when the next trigger point occurs and will wait until that trigger point occurs. For example, if the drilling stage has ended, the trigger point will not occur and method 400 proceeds to a step 495. Other events can occur, such as a stuck drill string or other operational events that end the trigger point check. Otherwise, the trigger point check can wait at step 440 until the next trigger point at which method 400 proceeds to step 415 for the next iteration, for example, the passing of a periodic time interval or the passing of a periodic drilling distance interval. In some aspects, the trigger point is in real-time or near real-time which means that method 400 will proceed to step 415 to proceed to the next iteration without waiting for a periodic time or distance interval. Method 400 ends at step 495.

FIG. 5 is an illustration of a block diagram of an example drilling optimizer 500, which can be implemented in one or more computing systems, for example, a data center, cloud environment, server, laptop, smartphone, tablet, and other computing systems. In some aspects, drilling optimizer 500 can be implemented using a drilling optimizer controller such as drilling optimizer controller 600 of FIG. 6. Drilling optimizer 500 can implement one or more methods of this disclosure, such as method 400 of FIG. 4.

Drilling optimizer 500, or a portion thereof, can be implemented as an application, a code library, a dynamic link library, a function, a module, other software implementation, or combinations thereof. In some aspects, drilling optimizer 500 can be implemented in hardware, such as a ROM, a graphics processing unit, or other hardware implementation. In some aspects, drilling optimizer 500 can be implemented partially as a software application and partially as a hardware implementation. Drilling optimizer 500 shows components that perform functions of the disclosed processes and an implementation can combine or separate at least some of the described functions in one or more software or hardware systems.

Drilling optimizer 500 includes a data transceiver 510, an drilling optimizer 520, and a result transceiver 530. Data transceiver 510, drilling optimizer 520, and result transceiver 530 can be, or can include, conventional interfaces configured for transmitting and receiving data. Data transceiver 510 can receive input parameters, such as parameters to direct the operation of the analysis implemented by drilling optimizer 520, such as identifying which algorithms to utilize and specifying operational parameters. In some aspects, data transceiver 510 can be part of drilling optimizer 520.

Drilling optimizer 520 can be a drilling optimization processor and can implement the analysis and algorithms as described herein utilizing the input parameters, such as to track a drilling trajectory, optimize the drilling parameters to put the drilling on an improved trajectory, and update the drilling parameters (e.g., directing a geo-steering system or a well site controller). For example, drilling optimizer 520 can perform the analysis of the input parameters, compute risk analysis, generate results including one or more recommendations, optimizations, and updates to the current drilling operation plan, and communicate the results to other systems, such as a reservoir planning system, a drilling planning system, a geo-steering system, a well site controller, or other well site systems. In some aspects, drilling optimizer 520 can be a machine learning system, such as providing a process to analyze the collected input parameters from downhole sensors to provide a quality check on the data and to fill in potential gaps in the data.

A memory or data storage of drilling optimizer 520 can be configured to store the processes and algorithms for directing the operation of drilling optimizer 520. Drilling optimizer 520 can also include one or more processors that is configured to operate according to the analysis operations and algorithms disclosed herein, and an interface to communicate (transmit and receive) data.

Result transceiver 530 can communicate one or more results, analysis, or interim outputs, to one or more data receivers, such as a user or user system 560, a computing system 562, a borehole system 564, a geo-steering system 566, or other systems 568 for processing or storing the recommendations, e.g., using a data store or database, whether located proximate result transceiver 530 or distant from result transceiver 530. The results and interim outputs from drilling optimizer 520, and other outputs, can be communicated to one or more of the data receivers for processing or storing data. The results can be used, for example, as inputs into a reservoir operation plan, a drilling operation plan, to determine the directions provided to a geo-steering system, or used as inputs into a well site controller or other borehole system, such as a well site operation planning system.

FIG. 6 is an illustration of a block diagram of an example of drilling optimizer controller 600 according to the principles of the disclosure. Drilling optimizer controller 600 can be stored on a single computer or on multiple computers.

The various components of drilling optimizer controller 600 can communicate via wireless or wired conventional connections. A portion or a whole of drilling optimizer controller 600 can be located at one or more locations, such as a data center, a reservoir controller, an edge computing system, a cloud environment, a server, a laptop, a smartphone, or other locations. In some aspects, drilling optimizer controller 600 can be wholly located at a downhole, a surface, or distant location. In some aspects, drilling optimizer controller 600 can be part of another system, and can be integrated in a single device, such as a part of a reservoir operation planning system, a well site controller, a geo-steering system, or other borehole system.

Drilling optimizer controller 600 can be configured to perform the various processes disclosed herein including receiving input parameters, and generating results from an execution of the methods and processes described herein. Drilling optimizer controller 600 includes a communications interface 610, a memory 620, and one or more processors represented by processor 630.

Communications interface 610 is configured to transmit and receive data. For example, communications interface 610 can receive the input parameters, downhole sensor parameters, and other data. Communications interface 610 can transmit the determined results (e.g., optimizations and updates to a drilling operation plan), data from the input parameters, or interim outputs. In some aspects, communications interface 610 can transmit a status, such as a success or failure indicator of drilling optimizer controller 600 regarding receiving the various inputs, transmitting the determined recommendations, or producing the determined results. In some aspects, communications interface 610 can communicate with an alert management system. The alert management system can be capable of receiving the one or more results and generating an alert or notification, using the one or more results, when an alert threshold is satisfied.

In some aspects, communications interface 610 can receive input parameters from a machine learning system, for example, where the downhole sensor parameters are processed using one or more filters and algorithms prior to computing the results.

In some aspects, the machine learning system can be implemented by processor 630 and perform the operations as described by drilling optimizer 520. Communications interface 610 can communicate via communication systems used in the industry. For example, wireless or wired protocols can be used. Communication interface 610 is capable of performing the operations as described for data transceiver 510 and result transceiver 530 of FIG. 5.

Memory 620 can be configured to store a series of operating instructions that direct the operation of processor 630 when initiated, including the code representing the algorithms used for processing the collected data. Memory 620 is a non-transitory computer readable medium. Multiple types of memory can be used for data storage and memory 620 can be distributed.

Processor 630, e.g., a drilling trajectory optimizer processor, can be configured to produce the results, e.g., the one or more recommendations, optimizations, updates, one or more interim outputs, and statuses utilizing the received inputs. Processor 630 can be configured to direct the operation of drilling optimizer controller 600. Processor 630 can be one or more processors. Processor 630 includes the logic to communicate with communications interface 610 and memory 620, and perform the functions described herein, such as functions according to method 400. Processor 630 is capable of performing or directing the operations as described by drilling optimizer 520 of FIG. 5.

A portion of the above-described apparatus, systems or methods may be embodied in or performed by various analog or digital data processors, wherein the processors are programmed or store executable programs of sequences of software instructions to perform one or more of the steps of the methods. A processor may be, for example, a programmable logic device such as a programmable array logic (PAL), a generic array logic (GAL), a field programmable gate arrays (FPGA), or another type of computer processing device (CPD). The software instructions of such programs may represent algorithms and be encoded in machine-executable form on non-transitory digital data storage media, e.g., magnetic or optical disks, random-access memory (RAM), magnetic hard disks, flash memories, and/or read-only memory (ROM), to enable various types of digital data processors or computers to perform one, multiple or all of the steps of one or more of the above-described methods, or functions, systems or apparatuses described herein.

Portions of disclosed examples or embodiments may relate to computer storage products with a non-transitory computer-readable medium that have program code thereon for performing various computer-implemented operations that embody a part of an apparatus, device or carry out the steps of a method set forth herein. Non-transitory used herein refers to all computer-readable media except for transitory, propagating signals. Examples of non-transitory computer-readable media include, but are not limited to: magnetic media such as hard disks, floppy disks, and magnetic tape; optical media such as CD-ROM disks; magneto-optical media such as floppy disks; and hardware devices that are specially configured to store and execute program code, such as ROM and RAM devices. Examples of program code include both machine code, such as produced by a compiler, and files containing higher level code that may be executed by the computer using an interpreter.

In interpreting the disclosure, all terms should be interpreted in the broadest possible manner consistent with the context. In particular, the terms "comprises" and "comprising" should be interpreted as referring to elements, components, or steps in a non-exclusive manner, indicating that the referenced elements, components, or steps may be present, or utilized, or combined with other elements, components, or steps that are not expressly referenced.

Those skilled in the art to which this application relates will appreciate that other and further additions, deletions, substitutions and modifications may be made to the described embodiments. It is also to be understood that the terminology used herein is for the purpose of describing particular embodiments only, and is not intended to be limiting, since the scope of the present disclosure will be limited only by the claims. Unless defined otherwise, all technical and scientific terms used herein have the same meaning as commonly understood by one of ordinary skill in the art to which this disclosure belongs. Although any methods and materials similar or equivalent to those described herein can also be used in the practice or testing of the present disclosure, a limited number of the exemplary methods and materials are described herein.

Each of the disclosed aspects in the SMMARY can have one or more of the following additional elements in combination. Element 1: communicating, using a result transceiver, the one or more results to a borehole system, wherein the borehole system is one or more of a reservoir system, a drilling system, a geo-steering system, a well site system, or a user system. Element 2: wherein a user or a machine learning system is utilized to select one result from the one or more results to be communicated to the borehole system. Element 3: wherein the corrections is more than one correction, and an optimization weighting parameter is applied to each of the one or more optimizations. Element 4: wherein the more than one correction is ranked approximately a same value and the more than one correction are used to determine the one or more results. Element 5: wherein the one or more results include a confidence level to identify a confidence that each result in the one or more results produces an outcome, where the outcome is indicated by the input parameters. Element 6: wherein the one or more optimizations are selected from geometric optimizations, well profile energy optimizations, mechanical optimizations, drill-ability optimizations, hydraulic optimizations, productivity optimizations, or geological optimizations. Element 7: wherein the receiving the system input parameters step, the determining the corrections step, the optimizing step, and the determining the one or more results step are performed at a periodic time interval parameter or a periodic drilling distance interval parameter, where the receiving the system input parameters utilize system input parameters received as of an execution of the receiving the system input parameters step. Element 8: wherein the one or more results include a notification or alarm of a detected safety concern or a factor that negatively impacts the drilling operation. Element 9: wherein the determining the corrections step further utilizes a machine learning system to implement a time-series analysis algorithm to reduce an impact of noise from downhole parameters of the system input parameters. Element 10: a machine learning system, capable of communicating with the data transceiver and the drilling optimizer processor, performing a time-series analysis of the system input parameters to reduce an impact of noise on the system input parameters. Element 11: a result transceiver, capable of communicating the one or more results to a user system, a data store, a computing system, or a borehole system. Element 12: wherein the borehole system is a geo-steering system and the geo-steering system utilizes the one or more results as directions. Element 13: wherein the one or more results are used to update a drilling operation plan. Element 14: an alert management system, capable of receiving the one or more results and generating an alert, using the one or more results, when an alert threshold is satisfied. Element 15: wherein the sensor parameters are received from one or more of equipment located downhole the borehole, surface equipment located proximate the borehole, or sensors capable to collect subterranean formation parameters near a drilling assembly.

What is claimed is:

1. A method, comprising:

receiving user input parameters associated with a drilling operation of a borehole;

receiving system input parameters, wherein the system input parameters include sensor parameters, where a drilling assembly is at a downhole end of the borehole, the sensor parameters are used to extrapolate an actual borehole trajectory, and the system input parameters are received in real-time or near real-time;

determining corrections to the actual borehole trajectory, wherein the corrections describe drilling parameter changes to align the actual borehole trajectory with a planned borehole trajectory;

optimizing the corrections to generate revised corrections, wherein one or more optimizations are selected to be applied to the corrections, each optimization of the one or more optimizations utilizes a respective optimization range parameter, where the optimizing includes adjusting at least one optimization of the one or more optimizations, when the at least one optimization is not satisfied, by using the respective optimization range parameter or modifying a weighting parameter of the at least one optimization, or by removing the at least one optimization from the one or more optimizations, and a minimum of one optimization in the one or more optimizations is a non-steering optimization for a drill bit; and determining one or more results utilizing the revised corrections, the user input parameters, or the system input parameters, wherein the results specify updated instructions to the drilling assembly thereby changing a trajectory of the drilling assembly.

2. The method as recited in claim 1, further comprising:

communicating, using a result transceiver, the one or more results to a borehole system, wherein the borehole system is one or more of a reservoir system, a drilling system, a geo-steering system, a well site system, or a user system.

3. The method as recited in claim 2, wherein a user or a machine learning system is utilized to select one result from the one or more results to be communicated to the borehole system.

4. The method as recited in claim 1, wherein the corrections is more than one correction, and an optimization weighting parameter is applied to each of the one or more optimizations.

5. The method as recited in claim 4, wherein the more than one correction uses a same approximate weighting and the more than one correction are used to determine the one or more results.

6. The method as recited in claim 1, wherein the one or more results include a confidence level to identify a confidence that each result in the one or more results produces an outcome, where the outcome is indicated by the input parameters.

7. The method as recited in claim 1, wherein the one or more optimizations are selected from geometric optimizations, well profile energy optimizations, mechanical optimizations, drill-ability optimizations, hydraulic optimizations, productivity optimizations, or geological optimizations.

8. The method as recited in claim 1, wherein the receiving the system input parameters step, the determining the corrections step, the optimizing step, and the determining the one or more results step are performed at a periodic time interval parameter or a periodic drilling distance interval parameter, where the receiving the system input parameters utilize system input parameters received as of an execution of the receiving the system input parameters step.

9. The method as recited in claim 1, wherein the one or more results include a notification or alarm of a detected safety concern or a factor that negatively impacts the drilling operation.

10. The method as recited in claim 1, wherein the determining the corrections step further utilizes a machine learning system to implement a time-series analysis algorithm to reduce an impact of noise from downhole parameters of the system input parameters.

11. A system, comprising:

a data transceiver, capable of receiving user input parameters and system input parameters for a borehole, wherein the system input parameters include sensor parameters from a drilling system, surface equipment, or subterranean formation parameters near the drilling system; and a drilling optimizer processor, capable of communicating with the data transceiver, generating one or more corrections utilizing the user input parameters and the system input parameters, revising the one or more corrections utilizing one or more optimizations to generate revised corrections, determining one or more results using the revised corrections, and the revising the one or more corrections includes adjusting at least one optimization of the one or more optimizations, when the at least one optimization is not satisfied, by using a respective optimization range parameter or modifying a weighting parameter of the at least one optimization, and a minimum of one optimization in the one or more optimizations is a non-steering optimization for a drill bit.

12. The system as recited in claim 11, further comprising:

a machine learning system, capable of communicating with the data transceiver and the drilling optimizer processor, performing a time-series analysis of the system input parameters to reduce an impact of noise on the system input parameters.

13. The system as recited in claim 11, further comprising:

a result transceiver, capable of communicating the one or more results to a user system, a data store, a computing system, or a borehole system.

14. The system as recited in claim 13, wherein the borehole system is a geo-steering system and the geo-steering system utilizes the one or more results as directions.

15. The system as recited in claim 11, wherein the one or more results are used to update a drilling operation plan.

16. The system as recited in claim 11, further comprising:

an alert management system, capable of receiving the one or more results and generating an alert, using the one or more results, when an alert threshold is satisfied.

17. A computer program product having a series of operating instructions stored on a non-transitory computer-readable medium that directs a data processing apparatus when executed thereby to perform operations to determine one or more results, the operations comprising:

receiving user input parameters associated with a drilling operation of a borehole;

receiving system input parameters, wherein the system input parameters include sensor parameters, where a drilling assembly is at a downhole end of the borehole, the sensor parameters are used to extrapolate an actual borehole trajectory, and the system input parameters are received in real-time or near real-time;

determining corrections to the actual borehole trajectory, wherein the corrections describe drilling parameter changes to align the actual borehole trajectory with a planned borehole trajectory;

optimizing the corrections to generate revised corrections, wherein one or more optimizations are selected to be applied to the corrections, and each optimization of the one or more optimizations utilizes a respective optimization range parameter, where the optimizing includes adjusting at least one optimization of the one or more optimizations, when the at least one optimization is not satisfied, by using the respective optimization range parameter or modifying a weighting parameter of the at least one optimization, and a minimum of one optimization in the one or more optimizations is a non-steering optimization for a drill bit; and determining one or more results utilizing the revised corrections, the user input parameters, or the system input parameters, wherein the results specify updated instructions to the drilling assembly thereby changing a trajectory of the drilling assembly.

18. The computer program product as recited in claim 17, wherein the sensor parameters are received from one or more of equipment located downhole the borehole, a surface equipment located proximate the borehole, or sensors capable to collect subterranean formation parameters near the drilling assembly.

19. The computer program product as recited in claim 17, wherein the one or more optimizations are selected from geometric optimizations, well profile energy optimizations, mechanical optimizations, drill-ability optimizations, hydraulic optimizations, productivity optimizations, or geological optimizations.

20. The computer program product as recited in claim 17, wherein the receiving the system input parameters step, the determining the corrections step, the optimizing the corrections step, and the determining the one or more results step are performed at a periodic time interval parameter or a periodic drilling distance interval parameter, where the receiving the system input parameters utilize system input parameters received as of an execution of the receiving the system input parameters step.

* * * * *